US006592282B2

(12) United States Patent
Fontanet et al.

(10) Patent No.: US 6,592,282 B2
(45) Date of Patent: Jul. 15, 2003

(54) COSMETIC APPLICATOR FOR FLUID MATERIAL

(75) Inventors: Osvaldo Fontanet, Ridgefield, NJ (US); Manharhbai Kantibhai Patel, Saddle Brook, NJ (US); Leo Clifford Pires, Basking Ridge, NJ (US); Barbara Poder-Stiso, Brick, NJ (US); James J. Thalheimer, Toms River, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 09/733,689

(22) Filed: Dec. 11, 2000

(65) Prior Publication Data

US 2002/0071708 A1 Jun. 13, 2002

(51) Int. Cl.[7] ..... B05C 11/00

(52) U.S. Cl. ..... 401/266; 401/6; 401/265; 401/262; 401/264; 401/188 R

(58) Field of Search ..... 401/202, 205, 401/206, 187, 188 R, 266, 265, 6, 262, 196, 261, 263, 264

(56) References Cited

U.S. PATENT DOCUMENTS

| | | | | |
|---|---|---|---|---|
| 1,890,599 A | | 12/1932 | Cobello | |
| 1,919,887 A | | 7/1933 | Gleeson | |
| 2,106,046 A | | 1/1938 | Barlow | 120/43 |
| 3,281,887 A | | 11/1966 | Raffe | 15/569 |
| 3,591,885 A | * | 7/1971 | Fritzen, Jr. | 15/210 |
| 3,862,806 A | | 1/1975 | Brown | 401/118 |
| 4,201,491 A | | 5/1980 | Kohler | 401/264 |
| 4,279,527 A | | 7/1981 | Moe | 401/277 |
| 4,368,746 A | | 1/1983 | Spatz | 132/88.5 |
| 4,674,903 A | | 6/1987 | Chen | 401/266 |
| 4,747,720 A | | 5/1988 | Bellehumeur et al. | 401/205 |
| 4,762,433 A | | 8/1988 | Bergeson et al. | 401/206 |
| 4,923,317 A | | 5/1990 | Bishop et al. | 401/205 |
| 4,983,061 A | * | 1/1991 | Demarest | 401/148 |
| 4,993,859 A | | 2/1991 | Assad et al. | 401/206 |
| 5,018,894 A | | 5/1991 | Goncalves | 401/202 |
| 5,568,990 A | | 10/1996 | McAuley | 401/206 |
| 5,577,851 A | * | 11/1996 | Koptis | 401/265 |
| 5,692,846 A | | 12/1997 | Schwarzberg | 401/190 |
| 5,967,685 A | | 10/1999 | De Laforcade | 401/190 |
| 5,988,923 A | | 11/1999 | Arai | 401/262 |
| 6,033,143 A | | 3/2000 | Gueret | 401/129 |
| 6,053,184 A | * | 4/2000 | DeVone | 132/317 |
| 6,059,473 A | | 5/2000 | Gueret | 401/129 |

FOREIGN PATENT DOCUMENTS

| | | |
|---|---|---|
| ES | 1032291 | 6/1995 |

* cited by examiner

*Primary Examiner*—David J. Walczak
(74) *Attorney, Agent, or Firm*—Julie Blackburn

(57) ABSTRACT

A cosmetic applicator for a fluid material which comprises a container and a dispenser. Generally, the dispenser works by an actuating mechanism. In particular, a user depresses an ergonomically shaped top portion, which then actuates a pump that pumps a fluid cosmetic material from the lower portion of the container by means of a conduit through an aperture. The fluid cosmetic material pumped through the conduit and the aperture from the lower portion of the container rises through the conduit and saturates the closed cell sponge tip. The user then glides the closed cell sponge tip across her skin to apply the fluid cosmetic material. The cosmetic applicator is hermetically sealed with a cap, which can be removed by the user.

20 Claims, 2 Drawing Sheets

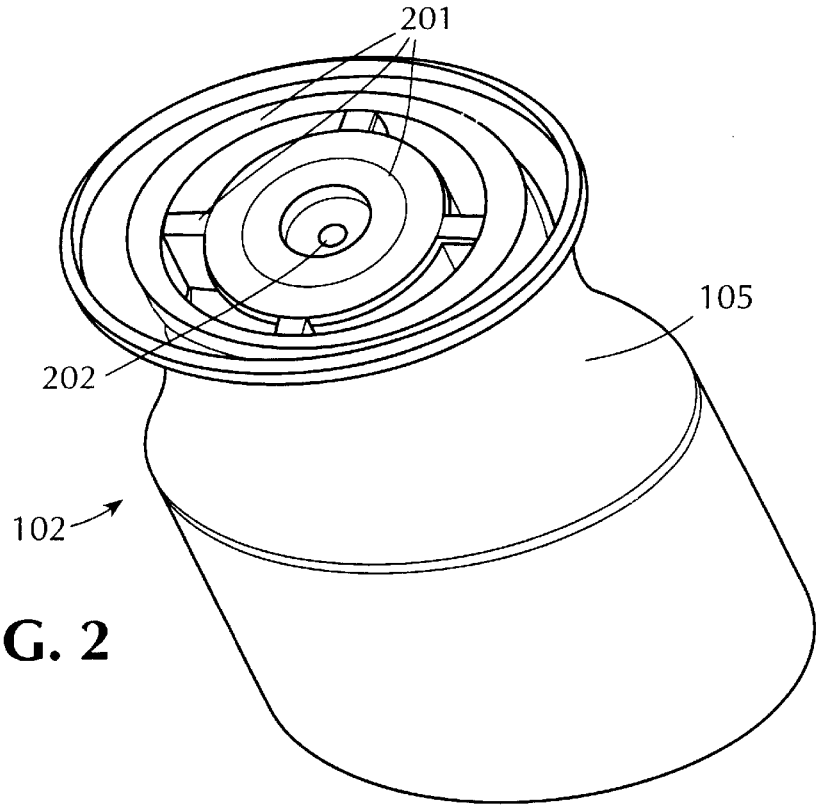
FIG. 2
FIG. 3
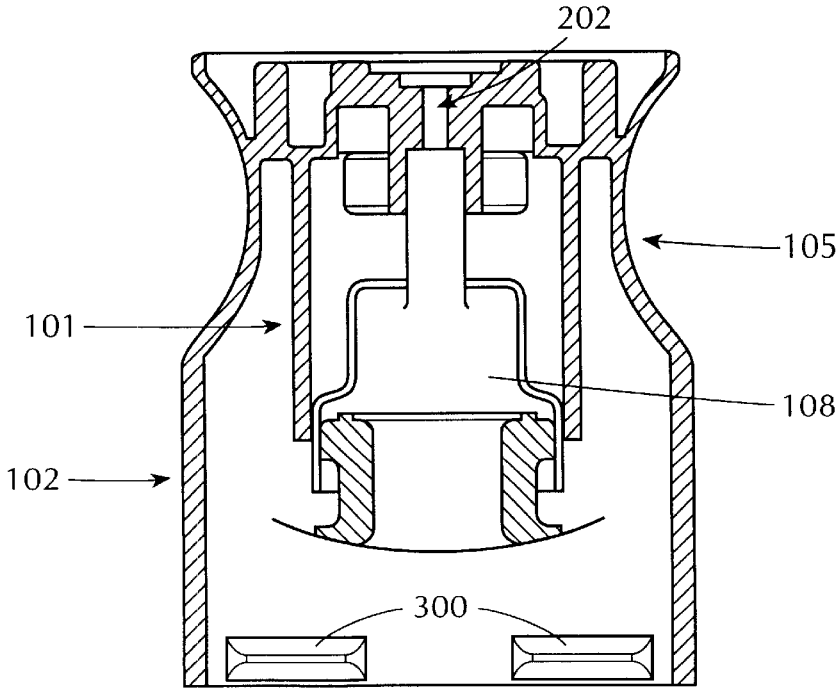

COSMETIC APPLICATOR FOR FLUID MATERIAL

FIELD OF THE INVENTION

The present invention relates to cosmetic liquid applicators and, in particular to a cosmetic applicator which can be utilized to apply liquid foundation to the skin. Specifically, the cosmetic applicator is an integral container and dispenser for cosmetic fluid materials which is ergonomically shaped, contains relatively few parts, is easy to assemble and is reliable in operation.

BACKGROUND OF THE INVENTION

There are numerous types of fluid applicators on the market for applying waxes or polishes to shoes. Shoe polish applicators enable a user to apply a shoe polish liquid to the surface of a shoe while minimizing any smearing or application to an unintended surface. Some applicators have an integrally formed open cell foam sponge applicator that helps spread the liquid polish onto the shoe surface. Typically, a user applies the shoe polish by inverting and squeezing a flexible container attached to the applicator. A desired shine is achieved when the volatile components of the applied liquid evaporate from the shoe surface.

Generally, shoe polish applicators are crudely constructed and frequently subject to excessive leaks. Such applicators typically have a plastic or rubber tip affixed to the container opening. The container is generally filled with a shoe polish composition that is high in volatile organic compounds to facilitate quick drying of the shoe polish when applied to the desired surface. A sponge or cloth-like spreader is frequently placed over the plastic or rubber-type tip for facilitating the application of a uniform coat of polish. To apply the liquid polish, a user is required to invert the container and press the flexible or rubber-type tip and spreader onto a shoe surface with a sufficient force so that the tip deforms and an opening on the top of the rubber-type tip is caused to form a slit, thereby allowing the polish to flow through the slit and onto the desired areas of the shoe surface. When the user disengages the applicator from the shoe surface, the rubber-type tip returns to its original shape and the opening is shut once again. A person of ordinary skill in the art will readily appreciate that the opening cannot serve as an effective seal against volatile compounds contained in the liquid polish. Thus, over time, the liquid polish in the container tends to evaporate over time.

The present invention utilizes fluid applicators similar to the shoe polish applicators described above. However, the invention provides an applicator for the application of liquid cosmetics such as foundation makeup, blush, lotions, astringents, toners, and the like. Such products are frequently packaged in bottles with screw caps. Liquid foundation packaged in such bottles is more difficult to apply. The user must first apply the makeup to their fingertips or to a secondary applicator (i.e., cotton ball, cotton swab, pad, etc.) and then apply the makeup to the face. This leaves traces of foundation makeup on the fingers or the use of a secondary applicator for every application. This is both messy and a waste of makeup.

Another problem with liquid cosmetics, particularly pigmented products such as liquid foundation makeup is that they cannot be dispensed from inexpensive and popular containers such as compacts due to the fact that the product would not be properly enclosed or contained. For this reason cosmetic formulators will make solid or semi-solid pigmented cosmetics in favor of liquids. In the present invention, there does not exist a need to alter the makeup consistency or the makeup formula to properly package the liquid foundation.

Kohler U.S. Pat. No. 4,201,491 discloses a liquid applicator which attempts to provide an improved applicator capable of providing a flow directed by a gravitational force. However, the liquid applicator disclosed in Kohler does not exhibit an actuating mechanism and a closed cell sponge tip. In addition, Kohler's liquid applicator cannot evenly and effectively apply a cosmetic liquid which is minimally influenced by a gravitational force. Likewise, Kohler's liquid applicator cannot effectively apply a cosmetic liquid in an upward or downward direction. Furthermore, Kohler fails to disclose an ergonomically shaped top portion for use in cosmetic applications.

Moe et. al. U.S. Pat. No. 4,279,527 discloses a liquid dispenser and applicator for use with a squeeze-type container. This embodiment teaches of a dispenser and an affixed brush member for a variety of uses including dispensing shoe polish, glue, paints, inks and liquid detergents, and is specifically designed as an improved applicator for use with paints, inks and the like. However, said disclosure fails to apply the invention to cosmetic products. In addition, this embodiment does not teach of the use of a closed cell tip which is conducive to the clean application of cosmetic liquid. Furthermore, this embodiment does not teach of an ergonomically shaped top portion for effective use in the field of cosmetic application.

McAuley U.S. Pat. No. 5,568,990 discloses a liquid applicator. However, this applicator strictly relates to shoe polish applications and is not applicable to the effective application of cosmetic liquid.

Schwarzberg U.S. Pat. No. 5,692,846 discloses a push button applicator device for dispensing liquids. This embodiment teaches of an applicator with a spongy material portion and not a closed cell sponge tip, which is conducive to the clean application of a cosmetic liquid. However, the spongy material tends to cause an uneven application of the fluid material. In addition, the embodiment does not teach of an ergonomically shaped top portion for effective use in the field of cosmetic applications.

Gueret U.S. Pat. No. 6,033,143 and Gueret U.S. Pat. No. 6,059,473 disclose an applicator for applying a liquid makeup product. However, these inventions fail to disclose an ergonomically shaped top portion, an actuating mechanism, a dispenser and a closed cell sponge tip for the proper application of liquid cosmetic products. These embodiments fail to disclose an apparatus which exhibits the same easy mode of operation and clean operation as set forth in the present invention.

In view of the foregoing, clearly there exists a need for an improved cosmetic applicator for fluid material that addresses the shortcomings of the prior art and overcomes the foregoing deficiencies. Thus, it is an object of the present invention to provide an improved cosmetic applicator which contains relatively few parts, is easy to assemble, demonstrates ease in operation, provides an uniform, controlled flow of fluid material and is reliable in operation.

SUMMARY OF THE INVENTION

Although numerous fluid applicators are readily available and marketed for the application of products for cleaning and maintaining shoes, it is a novel aspect of the present invention to utilize such an applicator for the application of cosmetics, wherein a uniform and controlled dispensing of fluid cosmetic material on a desired surface is required.

It is an object of the present invention to overcome the inconveniences and disadvantages of the prior art by offering the user a cosmetic applicator that applies a fluid material directly to the face of the user without requiring the user to first apply the fluid material to a secondary applicator or to their finger. Other objects and attendant advantages of the present invention will readily be perceived hereafter.

The improved cosmetic applicator for a fluid material consists of a hollow bodied container and a dispenser. In general, the dispenser works by an actuating mechanism. In particular, a user depresses an ergonomically shaped top portion, which then actuates a pump that pumps a certain quantity of fluid cosmetic material from the hollow bodied container to the dispenser by means of a conduit through an aperture. The makeup, pumped through the conduit and the aperture from the hollow bodied container, rises through the conduit and deposits on a closed cell foam sponge tip. The user then rubs the sponge tip across her skin to apply the fluid cosmetic material. The cosmetic applicator is hermetically sealed and protected with a cap which can be removed by the user for use thereof, and replaced when not in use (i.e. to prevent the cosmetic fluid material from accidentally dispensing or from drying up). The cap includes a means for engaging the dispenser portion of the applicator, whereby the cap, when engaged to the hollow bodied container, isolates the ergonomically shaped top portion and the closed cell sponge tip in order to avoid any leakage of the cosmetic fluid material while the cap is affixed.

A novel aspect of this invention is that the assembly comprising the actuating mechanism, the ergonomically shaped top portion and the closed cell foam sponge tip form one unit whereby the cosmetic material may be easily transported and cleanly applied by the user without brushes, applicator pads and the like. In addition, the integral cap, which is connected directly to the applicator, is a substantial improvement over other applicators because it avoids problems of leakage and loss of the contained fluid cosmetic material.

Another object of the invention is to provide a liquid cosmetic applicator incorporating a novel closed cell foam sponge tip. More specifically, the closed cell foam sponge tip is fully washable, thereby extending the useful life of the cosmetic applicator of the invention. A primary advantage of this construction is that the closed cell sponge foam tip allows for the smooth application of fluid material, specifically a fluid makeup composition. In addition, the closed cell foam sponge tip does not absorb the fluid material, thereby overcoming one of the disadvantages of the prior art. That is, the lack of absorption allows for easy removal of the makeup composition and subsequently easy cleanup.

Another novel aspect of this invention is the manner in which the closed cell foam tip is heat fused to the ergonomically shaped top portion for adhesion. The heat fused, ergonomically shaped top portion of the closed cell sponge tip yields desirable, previously unattainable results including the smooth application of the fluid to the user's skin with no leakage of the fluid. Others have attempted such a structure but have found that it is difficult to connect a closed cell sponge tip or similar foam material to an applicator. The unique use of heat fusing the closed cell sponge tip permits the fusion of specific portions of the closed cell sponge tip wherein only those predetermined specific portions are heated. Thus, the closed cell sponge tip is thoroughly sealed to the applicator and is not damaged in the process of adhesion. As a result, fluid materials will not leak through the fused joints or the closed cell sponge tip. Therefore, since the closed cell sponge tip is not damaged in the heat fusion process, fluid material flow is adequately restricted when no pressure is exerted on the dispenser. Furthermore, engaging the cap creates a closed system wherein a leakproof applicator is achieved. The cap may, if desired, be hermetically sealed. In addition, a primary advantage of the heat fused closed cell sponge tip and sealed cap comprises preventing inadvertent operation of the applicator during transport and storage.

Therefore, it is an object of the present invention to provide an improved cosmetic applicator which contains relatively few parts.

It is a further object of the present invention to provide an applicator which is easy to assemble.

Furthermore, it is an object of this invention to exhibit ease in operation.

Further, it is an object of this invention to provide an applicator for the clean and even controlled application of fluid cosmetic products.

In addition, it is an object of this invention to provide an applicator that is reliable in operation.

Other objects, features and characteristics of the present invention, as well as the methods of operation and functions of the related elements of the structure, and the combination of parts and economies of manufacture, will become more apparent upon consideration of the following detailed descriptions with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 2 is a perspective view of the ergonomically shaped top portion of the cosmetic fluid applicator and the dispenser portion of FIG. 1, prior to the heat fusion of the closed cell sponge foam tip thereto;

FIG. 3 is a cross sectional view of the ergonomically shaped top portion and the dispenser portion of the cosmetic fluid applicator of FIG. 1, prior to the heat fusion of the closed cell tip thereto.

DETAILED DESCRIPTION OF THE PREFERRED EMBODIMENTS

Figure 1:
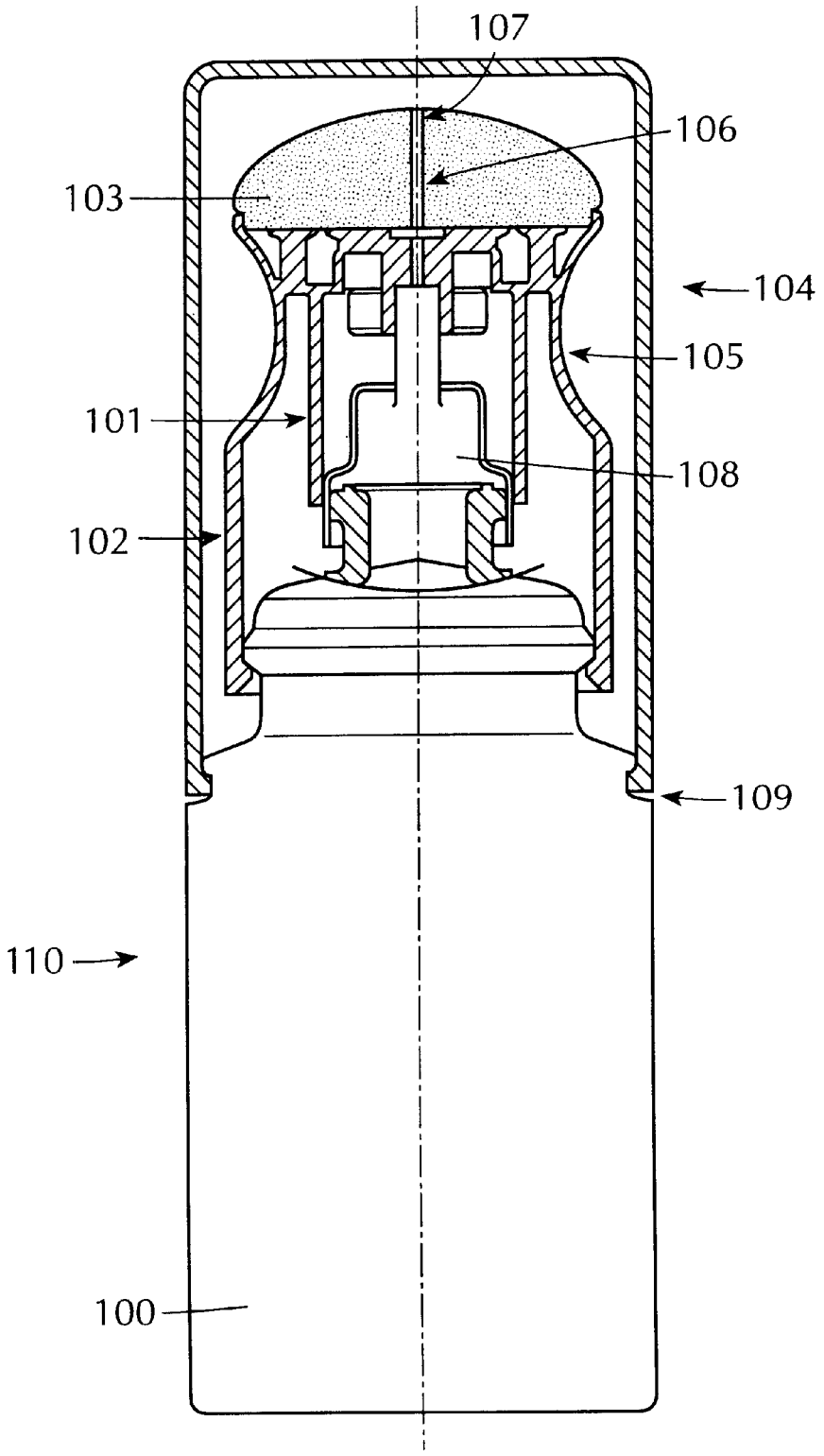
FIG. 1 is a front plan view of the preferred embodiment of a cosmetic fluid applicator according to the present invention.

As required, a detailed illustrative embodiment of the present invention is disclosed herein. However, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention. Referring first to FIG. 1, depicted is a frontal view of the preferred embodiment of the cosmetic fluid applicator 110. In this preferred embodiment, the improved cosmetic applicator 110 for a fluid material comprises a hollow bodied container 100 and a dispenser portion 102. Hollowed body container 100 may be filled during production prior to the assembly of the applicator. Said hollow bodied container 100 contains fluid cosmetic products including products such as blush, toner, liquid lipcolor, foundation makeup, astringent, lotion, liquid hair products such as rinses, colors, etc. Dispenser portion 102 comprises an actuating mechanism 101. To operate, a user depresses an ergonomically shaped top portion 105, which then actuates a pump 108 that pumps a certain quantity of fluid cosmetic material from the hollowed bodied container 100 to the dispenser portion 102 by means of conduits 202 and 106 through an aperture 107. While many variations of actuating mechanism 101, pump 108 and conduit 106 and 202 assemblies exist and may be used in the present invention, the preferred embodiment of actuating mechanism 101, pump 108 and conduits 106 and 202 operate when the user presses the ergonomically shaped top portion thereby compressing a spring and a check valve creating a decrease in pressure within the hollow bodied container 100 thus drawing the cosmetic liquid up through the hollow bodied container 100 to the dispenser portion 102 by means of the conduits 202 and 106 through the aperture 107. The liquid cosmetic product is pumped through the conduits 202 and 106 and the aperture 107 from the hollow bodied container and rises through the conduits 202 and 106. The conduit 106 meets the surface of the closed cell foam sponge tip 103 and deposits on the surface of the closed cell foam sponge tip 103, significantly reducing the reliance on capillary flow as demonstrated in the prior art. The user then glides the closed cell tip 103 across her skin to apply the fluid material contained in the hollow bodied container 100. The cosmetic applicator is hermetically sealed and protected with a removable cap 104 which can be removed by the user. Said cap 104 includes a means for engaging the dispenser portion 102 of the applicator, whereby the cap 104, when affixed to the dispenser portion 102 by fastening means 109, isolates the ergonomically shaped top portion 105 and the closed cell foam sponge tip 103 in order to avoid any leakage of the cosmetic fluid material while the cap 104 is affixed. While there are many variations of fastening means 109 which may be used in the present invention, in the preferred embodiment, the fastening means 109 consist of a raised lip and depression in the hollow bodied container 100 whereby the dispenser portion is snapped onto the raised lip of the hollow bodied container 100 and rests in the depression in the hollow bodied container 100. Some alternative embodiments for the fastening means 109 and the cap 104 may include a screw-type assembly, a twist-on assembly, a clamp-type assembly or a machine molded attachment. The dispenser portion 102 and the ergonomically shaped top portion 105 are completely protected when not in use by the cap 104. The cap 104 can have different shapes depending on the curvature and the construction of the dispenser portion 102. Although many variations of cap 104 exist and may be used in the present invention, the preferred embodiment of cap 104 consists of a molded plastic material that is snapped onto a raised lip of the hollow bodied container 100.

Turning next to FIG. 2, depicted is a further understanding of the present invention wherein the preferred embodiment of the dispenser 102 and the ergonomically shaped top portion 105 are shown. Shown are the coupling mechanisms 201 which may be used in the heat fusion process which adheres the closed cell foam sponge tip 103 to the ergonomically shaped top portion 105 (see also FIG. 1). Also shown is the upper end of the conduit 202. Conduit 202 is connected at its lower end to actuating mechanism 101. At its upper end, conduit 202 leads into conduit 106 of closed cell sponge tip 103 for dissemination and application of the fluid cosmetic material through aperture 107. Referring next to FIG. 3, shown is a cross sectional view of dispenser portion 102, ergonomically shaped top portion 105, pump 108 and conduit 106. FIG. 3, further depicts a cross-sectional view of the actuating mechanism 101 through which the fluid cosmetic material passes. Actuating mechanism 101 forces the fluid cosmetic material through the conduit 106 which disseminates the cosmetic fluid material onto the closed cell sponge tip 103 via conduit 106 and aperture 107 (see FIG. 1). Further depicted is a cross sectional view of an alternative embodiment of fastening means 300, whereby the dispenser portion is affixed to the hollow bodied container 100 by a machine molded attachment (see FIG. 1).

While the present invention has been described with reference to the preferred embodiments, which embodiments have been set forth in considerable detail for the purposes of making a complete disclosure of the invention, such embodiments are merely exemplary and are not intended to be limiting or represent an exhaustive enumeration of all aspects of the invention The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

We claim:

1. An improved cosmetic applicator for fluid material comprising:

a hollow bodied container having an internal reservoir for retaining a plurality of fluid materials wherein said hollow bodied container has an open top; and a one-piece dispenser having an upper end which is a depressible ergonomically shaped top having an actuating mechanism with a pump contained therein and a lower end wherein said lower end is affixed to the open top of the hollow bodied container, wherein said ergonomically shaped top has affixed thereto a closed cell foam applicator tip; and a removable sealed cap disposed thereon;

wherein depressing said ergonomically shaped top actuates the pump in the actuating mechanism which displaces a quantity of fluid of material residing in the internal reservoir of the hollow bodied container and disperses said fluid material on the surface of the closed cell sponge tip by means of a conduit through an aperture located on said closed cell sponge tip.

2. The improved cosmetic applicator according to claim 1 wherein the ergonomically shaped top portion has a plurality of coupling mechanisms disposed thereon.

3. The improved cosmetic applicator according to claim 2 wherein said plurality of coupling mechanisms adhere the closed cell foam applicator tip to the ergonomically shaped top portion.

4. The improved cosmetic applicator according to claim 3 wherein said closed cell sponge tip is heat fused to the plurality of coupling mechanisms on the ergonomically shaped top portion.

5. The improved cosmetic applicator according to claim 1 wherein the sealed cap includes a fastening means for engaging the hollow bodied container, said cap covering the ergonomically shaped top portion and the closed cell sponge applicator tip thereon.

6. The cosmetic applicator according to claim 1 wherein the cap is hermetically sealed.

7. The improved cosmetic applicator according to claim 1 wherein said closed cell sponge tip is heat fused to the ergonomically shaped top portion.

8. An improved cosmetic applicator for fluid material comprising:

a hollow bodied container having an internal reservoir which contains a fluid material wherein said hollow bodied container has an open top; and a one-piece dispenser having an upper end which is a depressible ergonomically shaped top having an actuating mechanism with a pump contained therein and a lower end wherein said lower end is affixed to the open top of the hollow bodied container, wherein said ergonomically shaped top has affixed thereto a closed cell foam applicator tip; and a removable sealed cap disposed thereon;

wherein depressing said ergonomically shaped top actuates the pump in the actuating mechanism which displaces a quantity of fluid of material residing in the internal reservoir of the hollow bodied container and disperses said fluid material on the surface of the closed cell sponge tip by means of a conduit through an aperture located in said closed cell sponge tip.

9. The cosmetic applicator according to claim 8 wherein the ergonomically shaped top portion has a plurality of coupling mechanisms disposed thereon.

10. The cosmetic applicator according to claim 9 wherein said closed cell sponge tip is heat fused to the plurality of coupling mechanisms on the ergonomically shaped top portion.

11. The cosmetic applicator according to claim 8 wherein said plurality of coupling mechanisms adhere the closed cell foam applicator tip to the ergonomically shaped top portion.

12. The cosmetic applicator according to claim 8 wherein said closed cell sponge tip is heat fused to the ergonomically shaped top portion.

13. The cosmetic applicator according to claim 8 wherein said sealed cap includes a fastening means for engaging the hollow bodied container, said cap covering the ergonomically shaped top portion and the closed cell sponge applicator tip thereon.

14. The cosmetic applicator according to claim 8 wherein the fluid material is a pigmented cosmetic product.

15. The cosmetic applicator according to claim 14 wherein the pigmented cosmetic product is blush, liquid lipcolor, foundation makeup, astringent, or lotion.

16. The cosmetic applicator according to claim 8 wherein the fluid material is a lotion or astringent.

17. The cosmetic applicator according to claim 8 wherein the fluid material is a foundation makeup.

18. The cosmetic applicator according to claim 8 wherein the fluid material is a liquid lipcolor.

19. The cosmetic applicator according to claim 8 wherein the fluid material is a liquid haircolor.

20. The cosmetic applicator according to claim 8 wherein the cap is hermetically sealed.

* * * * *